US011161640B2

(12) United States Patent
Nishigaito et al.

(10) Patent No.: US 11,161,640 B2
(45) Date of Patent: Nov. 2, 2021

(54) UNPACKING SYSTEM AND UNPACKING METHOD

(71) Applicant: Hitachi, Ltd., Tokyo (JP)

(72) Inventors: Takaomi Nishigaito, Tokyo (JP); Satoru Serizawa, Tokyo (JP); Tsunamichi Tsukidate, Tokyo (JP); Hiroshi Ikeda, Tokyo (JP)

(73) Assignee: HITACHI, LTD., Tokyo (JP)

( * ) Notice: Subject to any disclaimer, the term of this patent is extended or adjusted under 35 U.S.C. 154(b) by 0 days.

(21) Appl. No.: 16/920,829

(22) Filed: Jul. 6, 2020

(65) Prior Publication Data

US 2021/0086936 A1 Mar. 25, 2021

(30) Foreign Application Priority Data

Sep. 19, 2019 (JP) ..... JP2019-170700

(51) Int. Cl.
*B65B 69/00* (2006.01)

(52) U.S. Cl.
CPC ..... *B65B 69/0033* (2013.01); *B65B 69/0025* (2013.01)

(58) Field of Classification Search
CPC . B65B 69/00; B65B 69/0025; B65B 69/0033; B65B 69/0041
USPC .... 53/492, 381.1, 381.2, 382.1–382.3, 387.1
See application file for complete search history.

(56) References Cited

U.S. PATENT DOCUMENTS 2,997,833 A * 8/1961 Nigrelli et al. ..... B65B 43/38 53/382.1
2020/0306973 A1* 10/2020 Edwards et al. .... B65B 69/0033

FOREIGN PATENT DOCUMENTS

| | | | | |
|---|---|---|---|---|
| EP | 553362 A1 * | 8/1993 | | |
| EP | 2767372 A1 * | 8/2014 | ..... | B65B 69/0025 |
| JP | 03289430 A * | 12/1991 | | |
| JP | 2007-204048 A | 8/2007 | | |
| JP | 2008-001431 A | 1/2008 | | |
| WO | WO-9003314 A1 * | 4/1990 | ..... | B65B 69/0033 |

* cited by examiner

*Primary Examiner* — Stephen F. Gerrity
(74) *Attorney, Agent, or Firm* — Mattingly & Malur, PC

(57) ABSTRACT

An unpacking system that unpacks a box having flaps, including: an unsealing unit that cuts a proximity region where flaps facing each other in a closed state of flaps of the box come close together; a lid-opening unit that opens, at a predetermined angle exceeding 90 degrees, a predetermined flap of the flaps having been cut by the unsealing unit; and a flap cutting unit that cuts, along a side surface of the box, a base end side of the predetermined flap opened at the predetermined angle.

5 Claims, 16 Drawing Sheets

UNPACKING SYSTEM AND UNPACKING METHOD

CROSS-REFERENCE TO RELATED APPLICATION

The present application claims priority from Japanese application JP 2019-170700, filed on Sep. 19, 2019, the contents of which is hereby incorporated by reference into this application.

BACKGROUND OF THE INVENTION

1. Field of the Invention

The present invention relates to an unpacking system and an unpacking method.

2. Description of the Related Art

A device that automatically opens a box is known (JP 2008-1431 A and JP 2007-204048 A).

SUMMARY OF THE INVENTION

Boxes such as corrugated cardboard boxes have wide variety in shapes, articles stored in the boxes, and methods of storing the articles in the boxes. In order to unpack an article in a box without damaging it, the flap needs to be removed accurately. Furthermore, since the joint between the flaps that cover the upper opening of the box is often sealed with tape or the like, it is difficult to unpack automatically.

Furthermore, a picking process of taking out an article from the box by a robot may follow the latter stage of the unpacking process. In this case, it is necessary to automatically recognize the position and shape of the article by photographing the inside of the box with a camera. However, if the flap is not removed cleanly, there is a risk that the recognition accuracy of the article located in a peripheral portion of the box is reduced.

The present invention has been made in view of the above problem, and an object of the present invention is to provide an unpacking system and an unpacking method that are capable of unpacking a box with high reliability.

In order to solve the above problem, an unpacking system according to one aspect of the present invention is an unpacking system that unpacks a box having flaps, including an unsealing unit that cuts a proximity region where flaps facing each other in a closed state of flaps of the box come close together, a lid-opening unit that opens, at a predetermined angle exceeding 90 degrees, a predetermined flap of the flaps having been cut by the unsealing unit, and a flap cutting unit that cuts, along a side surface of the box, a base end side of the predetermined flap opened at the predetermined angle.

According to the present invention, the predetermined flap can be cut along a fold line between the base end side of the predetermined flap opened at an angle exceeding 90 degrees and the side surface of the box.

DESCRIPTION OF THE PREFERRED EMBODIMENTS

An embodiment of the present invention will be described below with reference to the drawings. In the present embodiment, the base end side of a predetermined flap is cut along the side surface of a box in a state where the predetermined flap that is a cutting target is opened at a predetermined angle. That is, opening the predetermined flap at the predetermined angle makes clear the line connecting the base end side of the predetermined flap and the side surface of the box, and makes the cutter as a cutting unit easier to enter mechanically. Therefore, according to the present embodiment, the flap can be removed cleanly without damaging an article in the box, and the accuracy of the image recognition processing in the next process can be prevented from being reduced.

In the following description, a corrugated cardboard box is exemplified as the box, but the present embodiment is not limited to the corrugated cardboard box, and can be applied to the box formed of other materials such as resin, wood, ceramics, and metal.

Unsealing and lid-opening are carried out by an unsealing/lid-opening robot 2 in the present embodiment, but instead, an unsealing robot and a lid-opening robot may be configured as separate robots.

First Example

Figure 1:
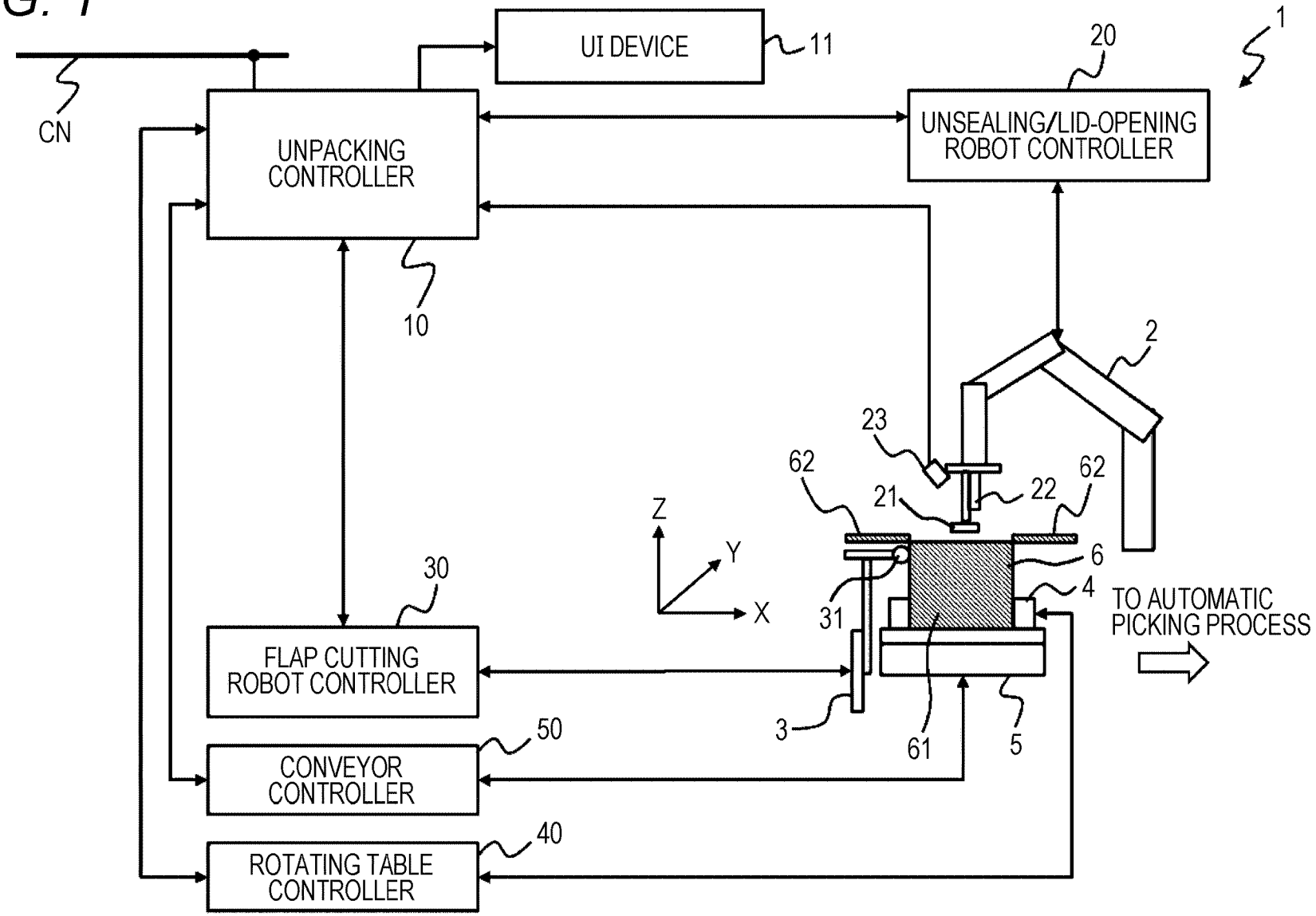
FIG. 1 is an overall configuration view of an unpacking system.

A first example will be described with reference to FIGS. 1 to 18. FIG. 1 is an overall configuration view of an unpacking system 1.

The unpacking system 1 includes, for example, the unsealing/lid-opening robot 2, a flap cutting robot 3, a rotating table 4, a conveyor 5, an unpacking controller 10, a user interface device 11, an unsealing/lid-opening robot controller 20, a flap cutting robot controller 30, a rotating table controller 40, and a conveyor controller 50.

Hereinafter, the unsealing/lid-opening robot may be referred to as an unsealing robot. Furthermore, an automatic picking process is provided as the next process of the unpacking system 1. In the automatic picking process, the position and shape of an article 7 in a box 6 are recognized by performing image processing using a camera, and the recognized article is taken out from the box 6 by a picking robot (both are not illustrated).

The unsealing robot 2 as an "unsealing unit" and a "lid-opening unit" is a 6-axis movable robot, for example. The unsealing robot 2 includes, at its tip, an unsealing multi-cutter 21, a suction hand 22, and a camera 23, for example. The unsealing multi-cutter 21 is an example of the "unsealing unit". The suction hand 22 is an example of the "lid-opening unit". The unsealing robot 2 is electrically connected to the unsealing robot controller 20 and operates in accordance with a control signal from the unsealing robot controller 20. The details of the multi-cutter 21 will be described later.

The flap cutting robot 3 as the "flap cutting unit" is configured as a 3-axis movable robot, for example. When the height direction of the box 6 is a Z direction, the width direction of the box 6 is an X direction, and the length direction of the box 6 is a Y direction, the flap cutting robot 3 is movable in the three directions of XYZ. The tip of the flap cutting robot 3 is provided with a flap cutting cutter 31. The flap cutting robot 3 is electrically connected to the flap cutting robot controller 30 and operates in accordance with a control signal from the flap cutting robot controller 30. The operations of the flap cutting robot 3 will be described later.

The rotating table 4 is provided in the middle of the conveyor 5. The rotating table 4 rotates in a predetermined direction by a predetermined angle in accordance with a control signal from the rotating table controller 40. The rotating table 4 is provided with a pusher 41 for holding and positioning the box 6 (see FIG. 2). The operation of each pusher 41 is also controlled by the rotating table controller 40.

The conveyor 5 is a device that conveys the box 6 in a predetermined direction. The conveyor 5 is electrically connected to the conveyor controller 50 and operates in accordance with a control signal from the conveyor controller 50. The conveyor 5 conveys the box 6 placed on an unillustrated carry-in unit towards the rotating table 4. The box 6 unpacked on the rotating table 4 is placed on the conveyor 5 again and conveyed for the picking process.

The unpacking controller 10 is a device that controls the overall operation of the unpacking system 1. The unpacking controller 10 can be configured as a computer system including, for example, a microprocessor, a memory, an auxiliary storage device, a communication interface, and an input/output interface (all are not illustrated). The unpacking controller 10 may be configured with a personal computer, a sequencer, a programmable logic controller, and the like. The unpacking controller 10 may be communicably connected to a higher-level computer system via a local area network CN.

The microprocessor of the unpacking controller 10 reads and executes a computer program stored in the memory or the auxiliary storage device of the unpacking controller 10, thus fulfilling a function as the unpacking system 1 of the present example. All or part of the computer program can be distributed via a storage medium or a communication network.

Figure 11:
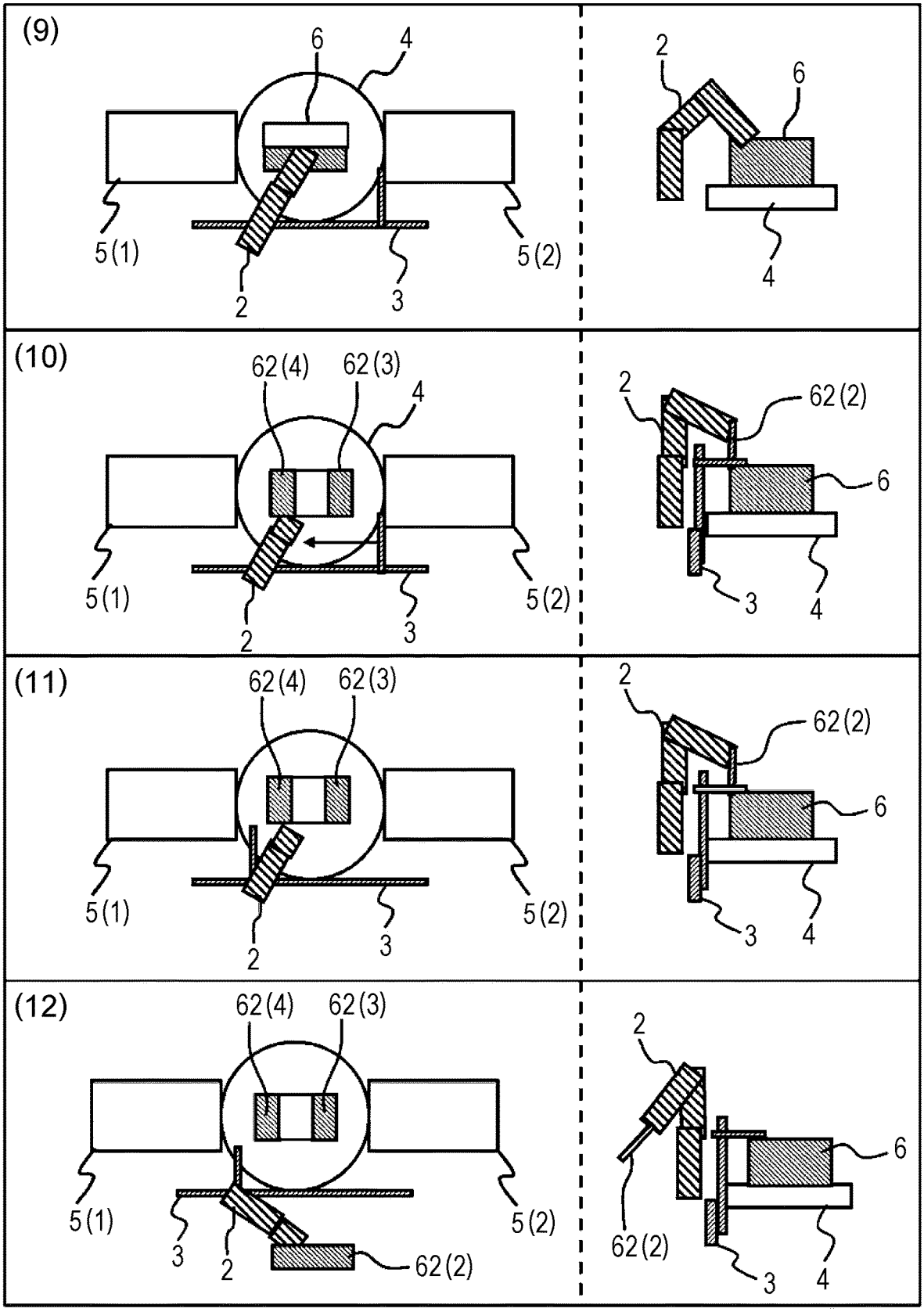
FIG. 11 is an explanatory view of steps (9)-(12) of the flow subsequent to the steps of FIG. 10.

The user interface device (UI device in the FIG. 11 is connected to the unpacking controller 10 so as to exchange information. The user interface device 11 includes an information input device and an information output device. The information input device is a device by which a user such as a system administrator inputs a set value or an instruction to the unpacking controller 10. Examples of the information input device include, for example, a keyboard, a manual switch, a touch screen, and a voice input device. The information output device is a device that outputs information from the unpacking controller 10. Examples of the information output device include, for example, a monitor display, a printer, a lamp, and a buzzer.

Figure 3:
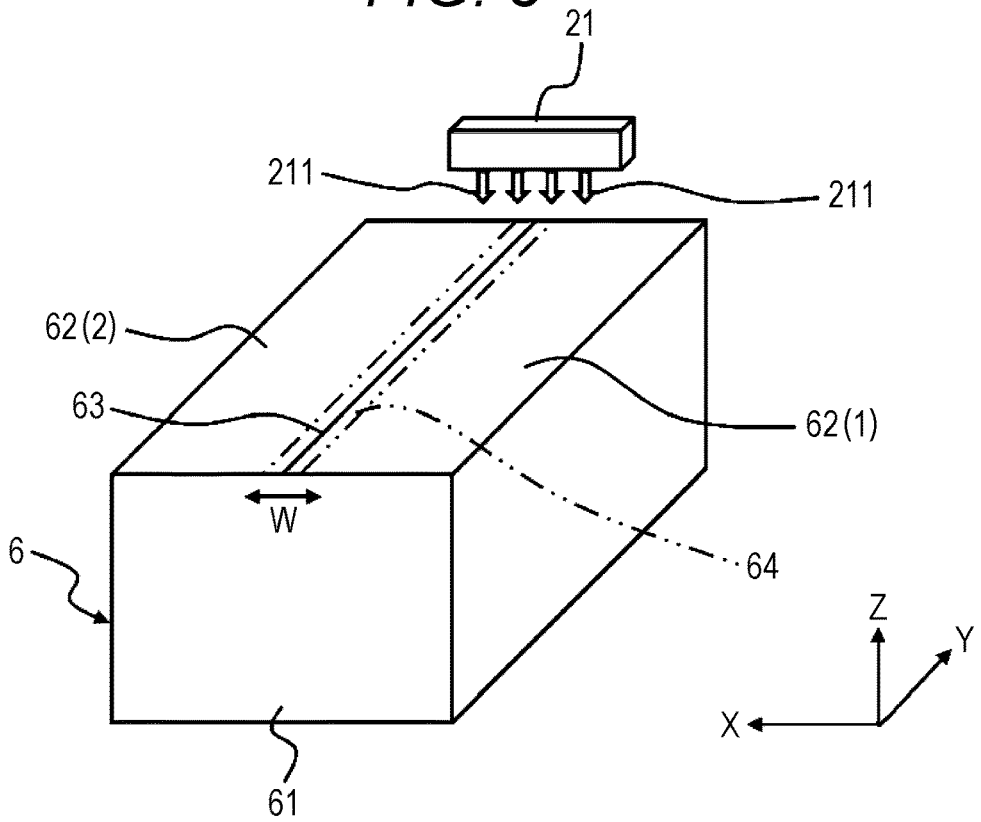
FIG. 3 is an explanatory view illustrating part of an unsealing robot in an enlarged manner.
Figure 5:
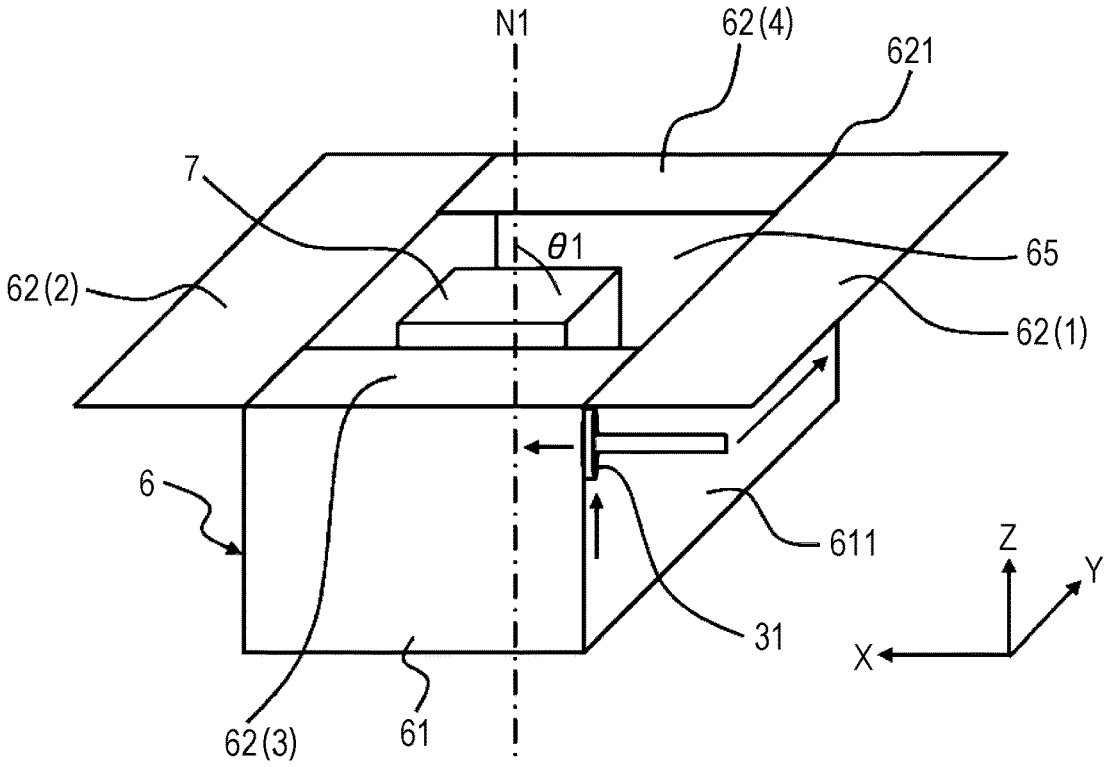
FIG. 5 is a perspective view of cutting a flap whose lid has been opened.

The box 6 is configured like, for example, a corrugated cardboard box, and includes a main body 61 and a plurality of flaps 62 that cover upper and lower openings 65 of the main body 61 (see FIGS. 3 and 5). Long flaps 62(1) and 62(2) facing in the width direction are provided in an openable/closable manner so as to cover the upper side of short flaps 62(3) and 62(4) facing in the longitudinal direction of the opening 65. These outermost flaps 62(1) and 62(2) are closed in a state of being in contact with each other, and a tape 64 is applied to the outside thereof. The tape 64 may be applied to a portion other than a portion 63 where the long flaps 62(1) and 62(2) abut against each other. A region W including the region to which the tape 64 is applied corresponds to the "proximity region where flaps come close together".

The arrangement relation among the conveyors 5(1) and 5(2), the rotating table 4, and the robots 2 and 3 will be described with reference to FIG. 2.

Figure 2:
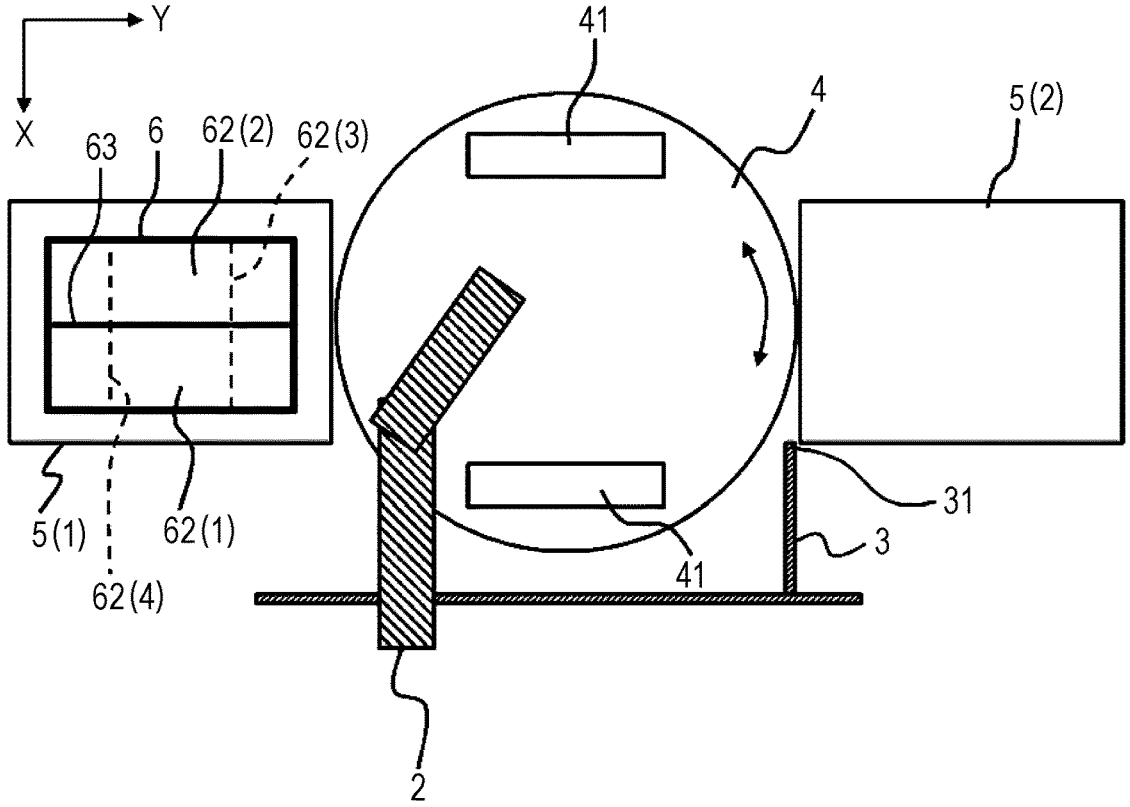
FIG. 2 is a top view illustrating an arrangement of a rotating table and each robot.

In FIG. 2, the box 6 is conveyed from the left side to the right side in the figure. The rotating table 4 is provided between the upstream side conveyor 5(1) and the downstream side conveyor 5(2). The rotating table 4 is provided with the pusher 41 for holding and positioning the box 6 from both sides. The pusher 41 is arranged along a side surface 611 of the box 6 corresponding to the cutting target flap. That is, the flap connected to the side surface 611 held by the pusher 41 is a cutting target by the flap cutting robot 3. A stopper 51 (see FIG. 6) that determines the position of the box 6 in the traveling direction may be provided on the rotating table 4 so as to be movable forward and backward.

In FIG. 2, both the unsealing robot 2 and the flap cutting robot 3 are arranged on one side of the both sides in the traveling direction of the box 6. Alternatively, the unsealing robot 2 and the flap cutting robot 3 may be arranged so as to face both sides in the traveling direction of the box 6.

A method of unsealing the flaps 62(1) and 62(2) outside the box 6 will be described with reference to FIG. 3. The unsealing multi-cutter 21 provided at the tip of the unsealing robot 2 has a plurality of blades 211 arranged in parallel and apart from each other. The unsealing multi-cutter 21 cuts off and unseals the flap 62(1) and the flap 62(2) from each other by cutting the region W where the flaps come close together in the Y direction along the portion 63 where the flap 62(1) and the flap 62(2) abut against each other. Thereafter, a predetermined flap of the flap 62(1) and the flap 62(2) is sucked by negative pressure by the suction hand 22 of the unsealing robot 2, and is opened to a predetermined angle. The blade 211 of the multi-cutter 21 may be a rotary blade.

If the portion 63 where the flaps 62(1) and 62(2) abut against each other can be accurately identified by image processing by the camera 23, the unsealing multi-cutter 21 may include only one blade 211 (may be a rotary blade). However, in reality, the box 6 is various, and the application method of the tape 64 is also various. Accordingly, in the present example, the plurality of blades 211 are used to reliably unseal the flaps 62(1) and 62(2) abutting against each other outside, and a plurality of portions are simultaneously cut and opened.

Figure 4:
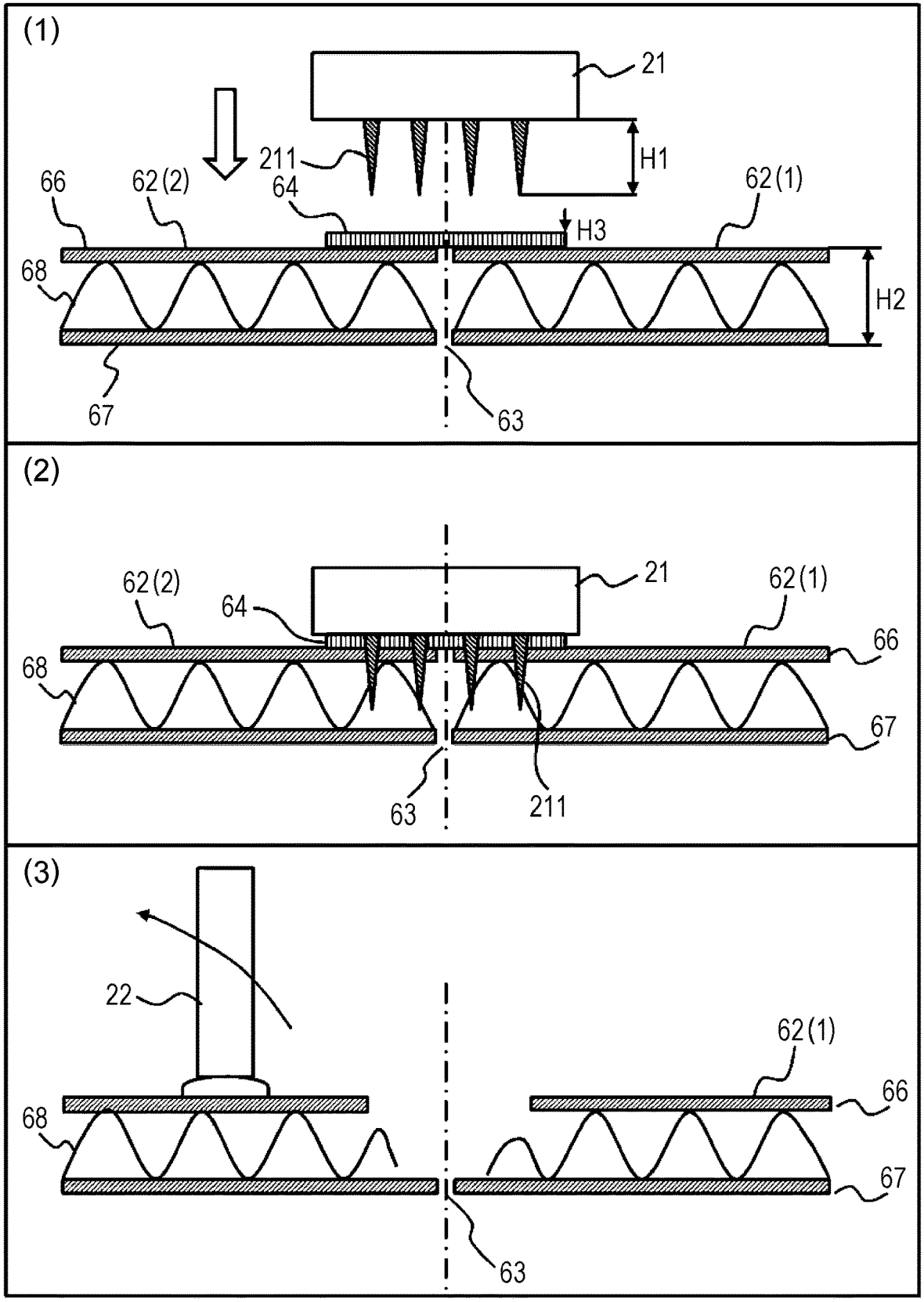
FIG. 4 is an explanatory view of steps (1)-(3) illustrating unsealing of a flap without completely cutting it.

FIG. 4 is an explanatory view of steps (1) to (3) of a flow in which the portion 63 where the flap 62(1) and the flap 62(2) abut against each other is cut and opened by the unsealing multi-cutter 21. As illustrated in the state immediately before the unsealing in FIG. 4(1), a length dimension H1 of the blade 211 of the unsealing multi-cutter 21 is set shorter than a thickness dimension H2 of the flap 62 (H1<H2). More specifically, the length dimension H1 is set so that the blade 211 does not completely cut the flap 62 in consideration of an amount by which the blade 211 is pressed against the flap 62 and a thickness dimension H3 of the tape 64.

The flap 62 includes, for example, a front liner 66, a rear liner 67, and a core 68 provided between the liners 66 and 67. In the unsealing state illustrated in FIG. 4(2), i.e., a state where the flap 62 is cut and opened by the respective blades 211, the edges of the respective blades 211 reach the core 68 but does not sufficiently reach the rear liner 67. Therefore, the flap 62 is cut by breaking the front liner 66 and the core 68, but the blades 211 do not penetrate the rear liner 67.

As illustrated in the suction state of FIG. 4(3), the flap of the box 6 is opened by sucking and pulling up a predetermined flap by the suction hand 22 in a state where the flap 62 is broken halfway. The tip of the blade 211 is not necessarily required to reach the rear liner 67, and may enter halfway in the thickness direction of the rear liner 67.

The blade 211 does not penetrate the flap 62, and originally the tip sides of the flaps are only in contact with each other at the portion 63 where the flaps abut against each other. Hence, the flap 62 can be easily pulled up by the suction hand 22 to open.

The configuration of the flap 62 is not limited to that illustrated in FIG. 4. There is a configuration in which one or more intermediate liners are provided between the front liner 66 and the rear liner 67. In this case, a core is formed between the inner liners. In either configuration, in the present example, the blade 211 of the multi-cutter 21 does not penetrate the flap 62. This can prevent the article 7 in the box 6 from being damaged by the blade 211, thus improving the reliability of the unpacking system 1.

A flap cutting method by the flap cutting robot 3 will be described with reference to FIG. 5. By the flap cutting cutter 31, the flap cutting robot 3 cuts a portion where the base end side (root side) of the flap 62 opened up to a predetermined angle θ1 and the side surface 611 of the box 6 are connected. In other words, the flap cutting robot 3 moves the cutter 31 along the side surface 611 while leaving the cutter 31 being pressed against a fold line portion 621 (see FIG. 6) between the flap 62 and the side surface 611. The predetermined angle θ1 is set to 180 degrees, which exceeds 90 degrees, for example. The angle does not need to be exactly 180 degrees but may be an angle at which the flap 62 becomes substantially horizontal.

Figure 6:
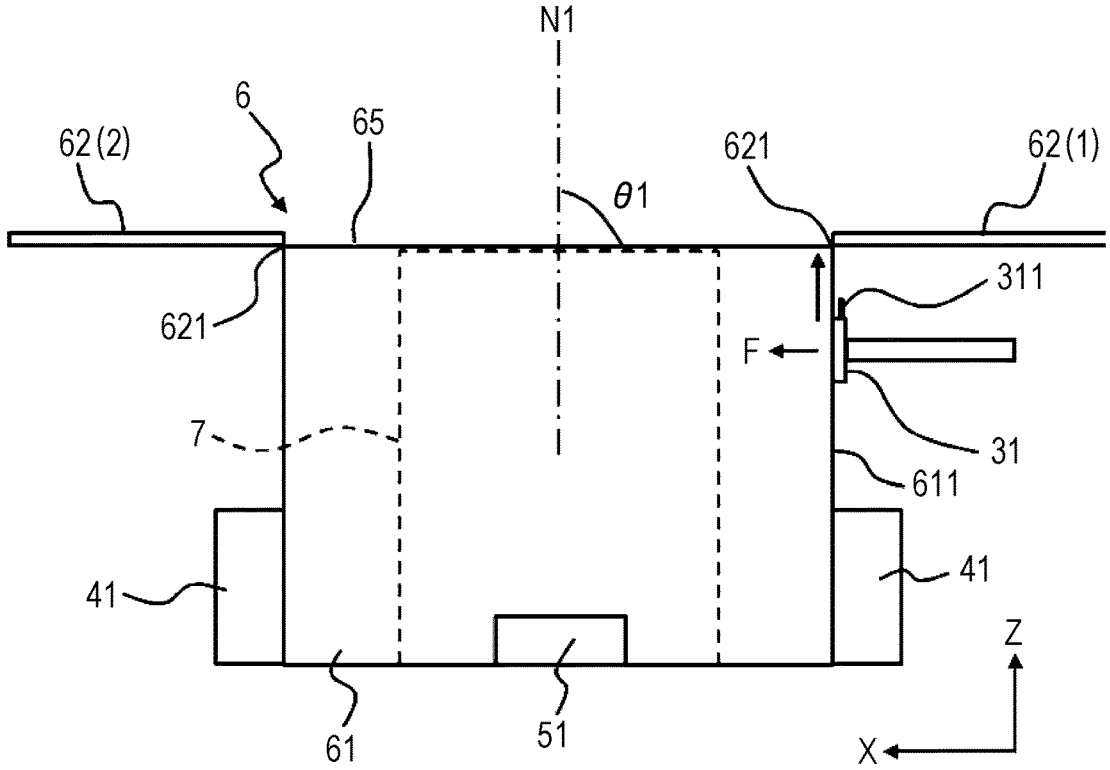
FIG. 6 is an explanatory view of cutting the flap seen from the front of the box.

FIG. 6 is an explanatory view seen from the front of the box 6. Both the side surfaces 611 of the box 6 are held from both sides by each of the pushers 41. The flap cutting robot 3 brings the cutter 31 closer from the X direction to contact a side surface 311, and presses it by a slight amount F. Thus, on the side surface 611 connected to the cutting target flap 62(1), the side surface 611 becomes substantially vertical because it is pushed by the pusher 41 located on the lower side and the cutter 31 located on the upper side.

That is, the side surface 611 connected to the cutting target flap 62(1) is substantially parallel to a normal N1 of the upper opening 65 (also referred to as an outlet 65) of the box 6. In this state, the cutter 31 is pressed against the connection portion 621 between the flap 62(1) and the side surface 611 and moved in the longitudinal direction of the flap 62(1), thus cutting the flap 62(1). Although the flap 62(1) has been described as an example here, the same is true for a case of cutting the other flaps 62(2) to 62(4).

The flow of the unpacking method will be described with reference to steps (1) -(3) of FIG. 7 and steps (4) to (5) of FIG. 8. A more detailed flow will be described later.

Figure 7:
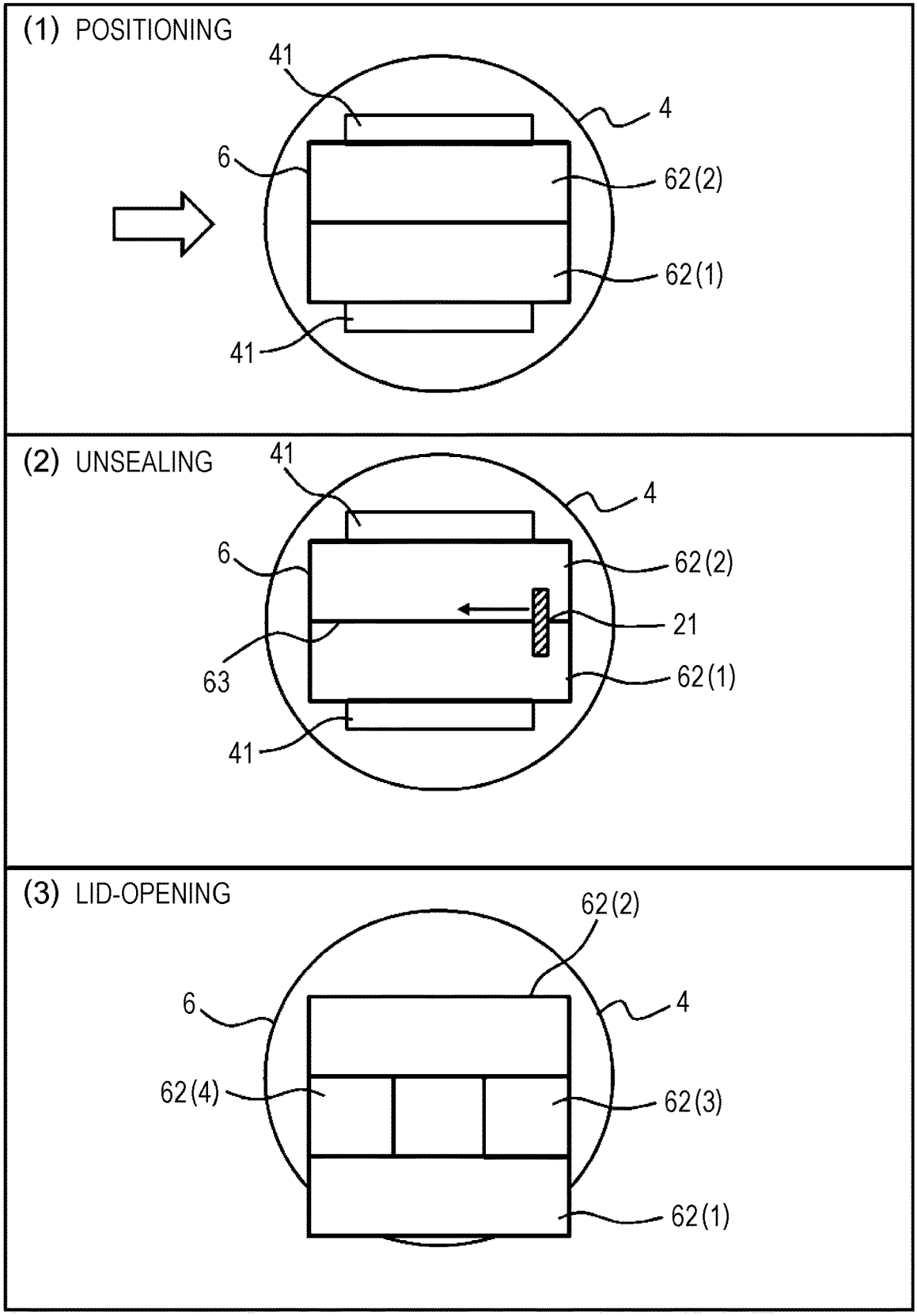
FIG. 7 is an explanatory view of steps (1) -(3) illustrating the flow of an unpacking method.

FIG. 7(1) illustrates a positioning step. In the positioning step, the unpacking controller 10 conveys the box 6 to the rotating table 4 and stops the box 6 at a predetermined position by the pusher 41 (and the stopper 51).

In the unsealing step of FIG. 7(2), the unpacking controller 10 causes the unsealing multi-cutter 21 of the unsealing robot 2 to cut and open centering on the portion 63 where the flaps abut against each other. However, as described in FIG. 6, since the dimension H1 of the blade 211 of the multi-cutter 21 is shorter than the thickness dimension H2 of the flap 62, the tip of the blade 211 does not penetrate the flap 62.

In the lid-opening step of FIG. 7(3), the unpacking controller 10 opens the cutting target flap 62(1) to a predetermined angle of equal to or greater than 90 degrees by the suction hand 22. The predetermined angle is set to be an acute angle with respect to the normal N1 of the outlet 65 covered with each flap. In the example described later, the predetermined angle is set to be an acute angle with respect to the side surface 611 of the box 6.

Figure 8:
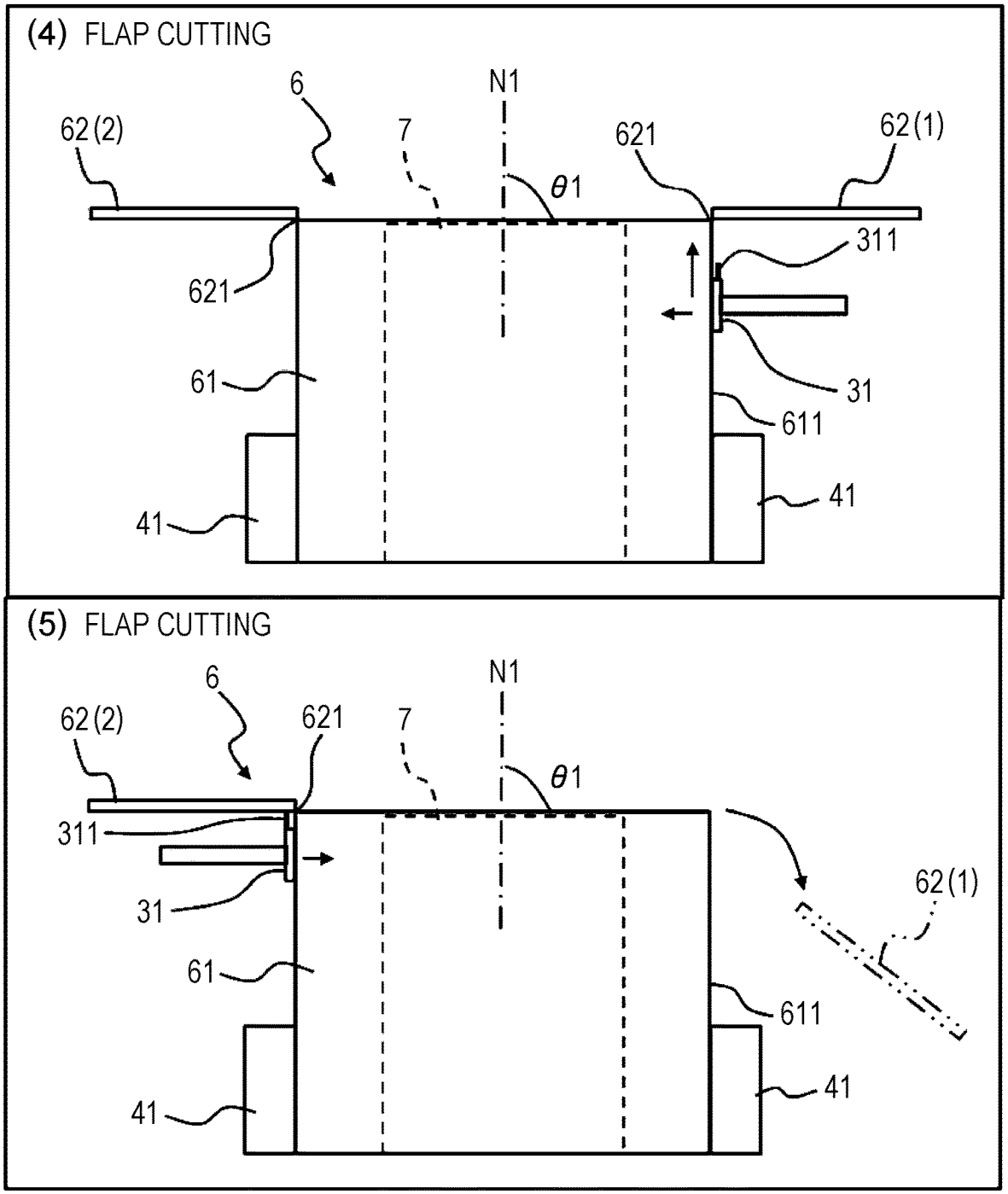
FIG. 8 is an explanatory view of steps (4) to (5) of the flow subsequent to the steps of FIG. 7.

In the flap cutting step illustrated in FIG. 8(4), the unpacking controller 10 moves the cutter 31 of the flap cutting robot 3 to the fold line portion 621 while slightly pressing the cutter 31 against the side surface 611 leading to the cutting target flap 62. The unpacking controller 10 cuts off the flap 62 by moving the cutter 31 of the flap cutting robot 3 along the side surface 611 (along the fold line portion 621).

In the other flap cutting step illustrated in FIG. 8(5), the unpacking controller 10 rotates the rotating table 4 by 180 degrees, thus causing the flap cutting robot 3 to cut the other flaps similarly. The flap 62 having been cut may be discarded by an unillustrated discarding robot.

Figure 9:
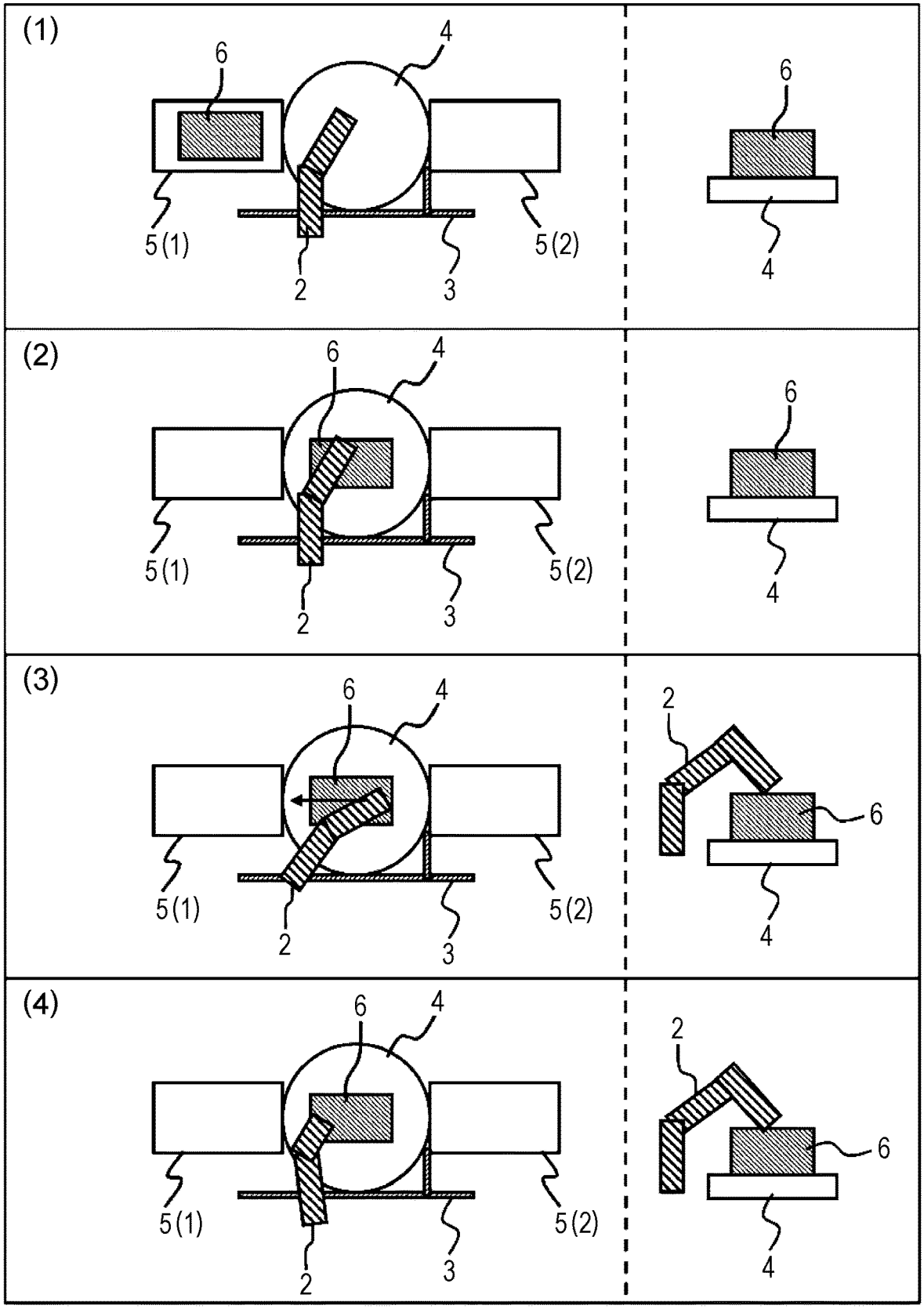
FIG. 9 is an explanatory view of steps (1)-(4) of a flow in a case of unpacking a corrugated cardboard box with one unsealing/lid-opening robot and one flap cutting robot.
Figure 10:
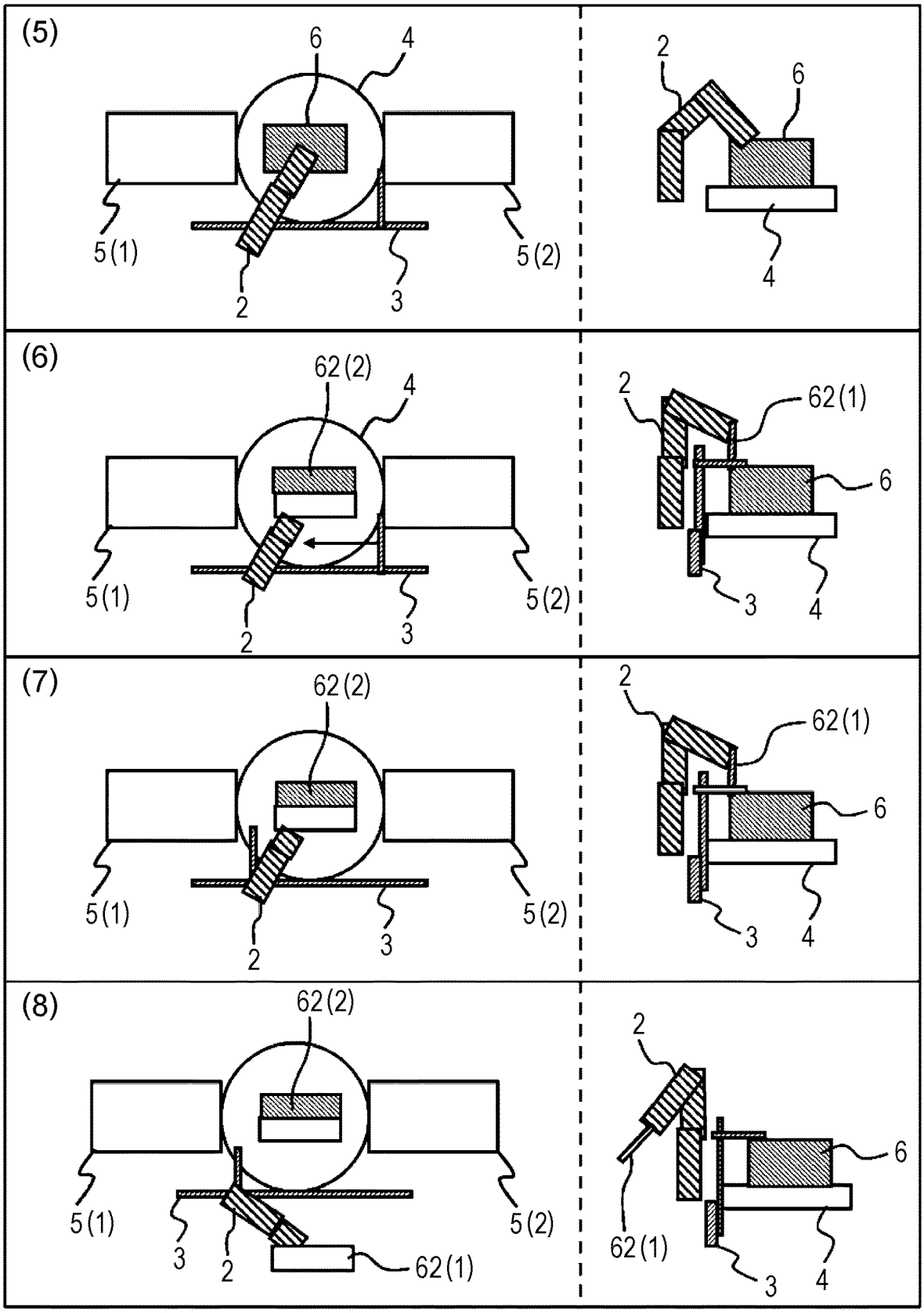
FIG. 10 is an explanatory view of steps (5)-(8) of the flow subsequent to the steps of FIG. 9.
Figure 12:
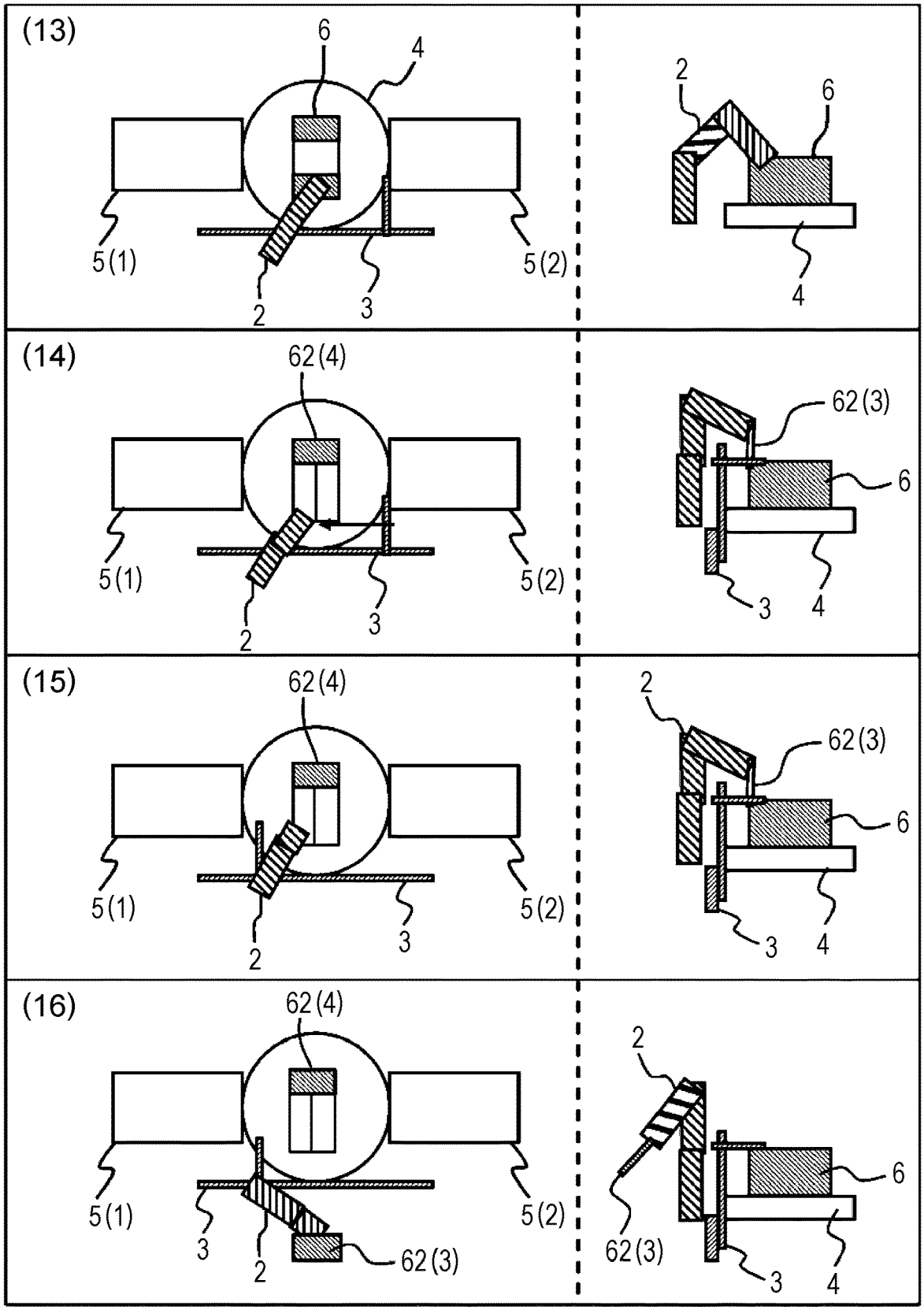
FIG. 12 is an explanatory view of steps (13) to (16) of the flow subsequent to the steps of FIG. 11.
Figure 13:
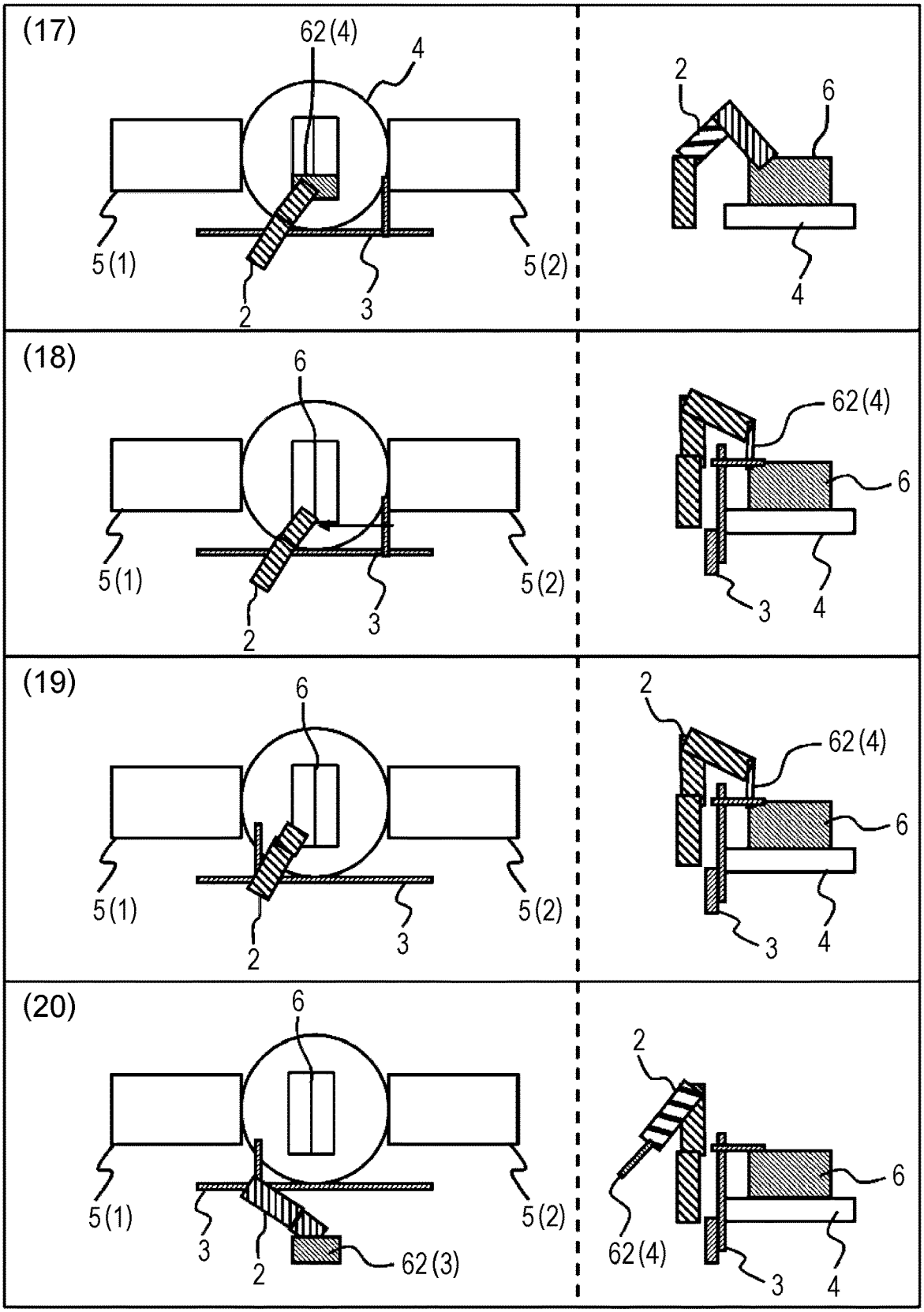
FIG. 13 is an explanatory view of steps (17) to (20) of the flow subsequent to the steps of FIG. 12.
Figure 14:
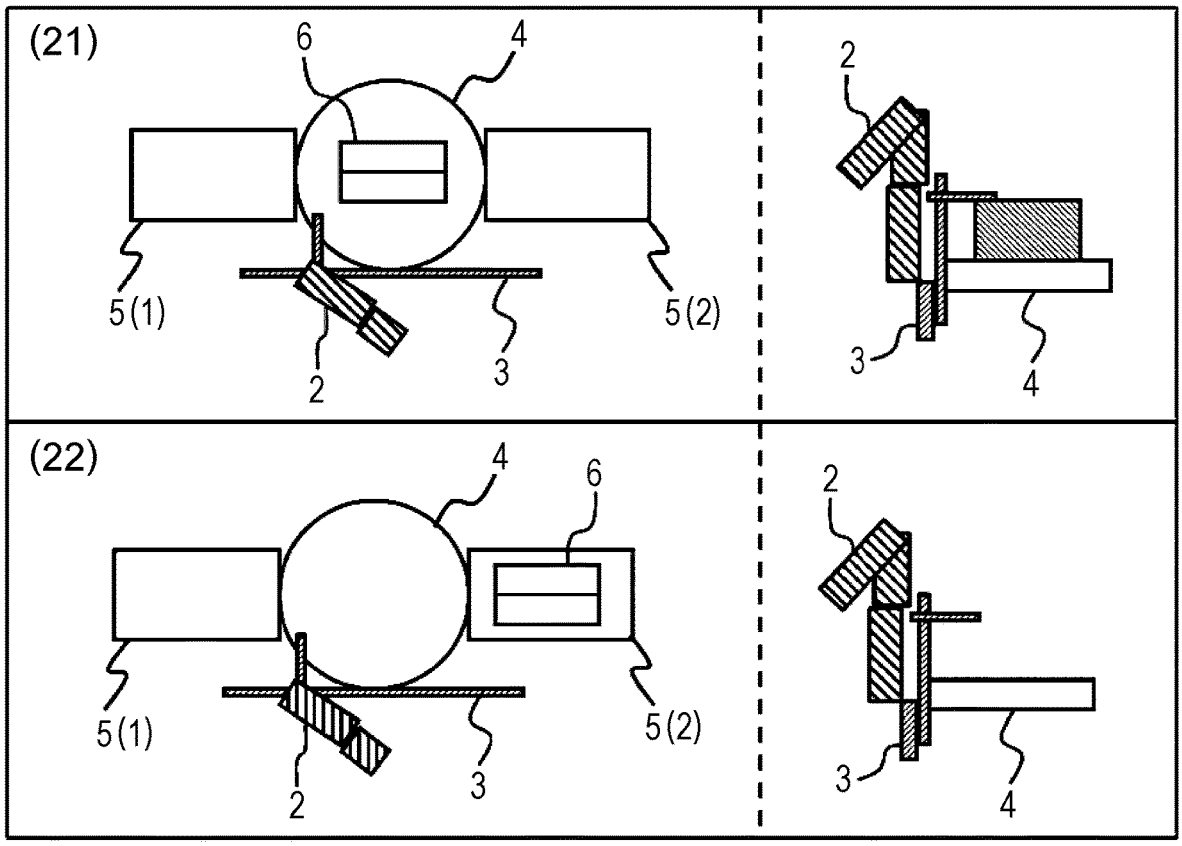
FIG. 14 is an explanatory view of steps (21) to (22) of the flow subsequent to the steps of FIG. 13.

The unpacking method in the case of a method using one unsealing robot 2 and one flap cutting robot 3 (referred to as a single cutter method for convenience) will be described with reference to steps (1) to (4) in FIG. 9, steps (5) to (8) in FIG. 10, steps (9) to (12) in FIG. 11, steps (13) to (16) in FIG. 12, steps (17) to 20) in FIG. 13 and steps (21) to (22) in FIG. 14. In FIGS. 9 through 16, the left side is an explanatory view seen from the upper side, and the right side is an explanatory view seen from the lateral side.

In the first step illustrated in FIG. 9(1), the unpacking controller 10 causes the conveyor 5(1) to carry the box 6 into the rotating table 4. In the second step illustrated in FIG. 9(2), the unpacking controller 10 recognizes a closed region (portion 63 of abutting) of the flap 62 by the camera 23 of the unsealing robot 2. In the third step of FIG. 9(3), the unpacking controller 10 starts unsealing the flap 62 by the unsealing robot 2. However, since the blade 211 of the multi-cutter 21 is shorter than the thickness of the flap 62, it does not penetrate the flap 62. In the fourth step of FIG. 9(4), the unsealing of the flap by the unsealing robot 2 ends. If the tape is applied to a portion other than the portion 63 where the flaps abut against each other, the unpacking controller 10 causes the unsealing robot 2 to also cut the portion.

In the fifth step of FIG. 10(5), the unpacking controller 10 causes the suction hand 22 of the unsealing robot 2 to pull up the flap close to the unsealing robot 2 and open the flap at a predetermined angle. In the sixth step of FIG. 10(6), the unpacking controller 10 causes the flap cutting robot 3 to start cutting the flap opened at the predetermined angle. In the seventh step of FIG. 10(7), the cutting of the flap ends. In the eighth step of FIG. 10(8), the unpacking controller 10 discards the flap having been cut.

In the ninth step of FIG. 11(9), the unpacking controller 10 rotates the rotating table 4 by 180 degrees and causes the unsealing robot 2 to pull up the flap 62 and open it at a predetermined angle. In the tenth step of FIG. 11(10), the unpacking controller 10 causes the flap cutting robot 3 to start cutting the opened flap. In the eleventh step of FIG. 11(11), the cutting of the flap ends. In the twelfth step in FIG. 11(12), the unpacking controller 10 discards the flap having been cut.

In the thirteenth step of FIG. 12(13), the unpacking controller 10 rotates the rotating table 4 by 90 degrees and pulls one of the short flaps toward the unsealing robot 2. In the fourteenth step of FIG. 12(14), the unpacking controller 10 causes the flap cutting robot 3 to start cutting the root of the opened flap. In the fifteenth step of FIG. 12(15), the cutting of the flap ends. In the sixteenth step of FIG. 12(16), the unpacking controller 10 discards the flap having been cut.

In the seventeenth step of FIG. 13(17), the unpacking controller 10 rotates the rotating table 4 by 90 degrees, pulls the other of the short flaps toward the unsealing robot 2, and opens the flap to a predetermined angle. In the eighteenth step of FIG. 13(18), the unpacking controller 10 causes the flap cutting robot 3 to start cutting the opened flap. In the nineteenth step of FIG. 13(19), the cutting of the flap ends. In the twentieth step of FIG. 13(20), the unpacking controller 10 discards the flap having been cut.

In the twenty-first step of FIG. 14(21), the unpacking controller 10 moves, to the conveyor 5(2), the box 6 from which all the flaps have been removed. In the twenty-second step of FIG. 14(22), the box 6 is placed on the conveyor 5(2) and sent to the next step (e.g., an automatic picking process with image processing).

Figure 15:
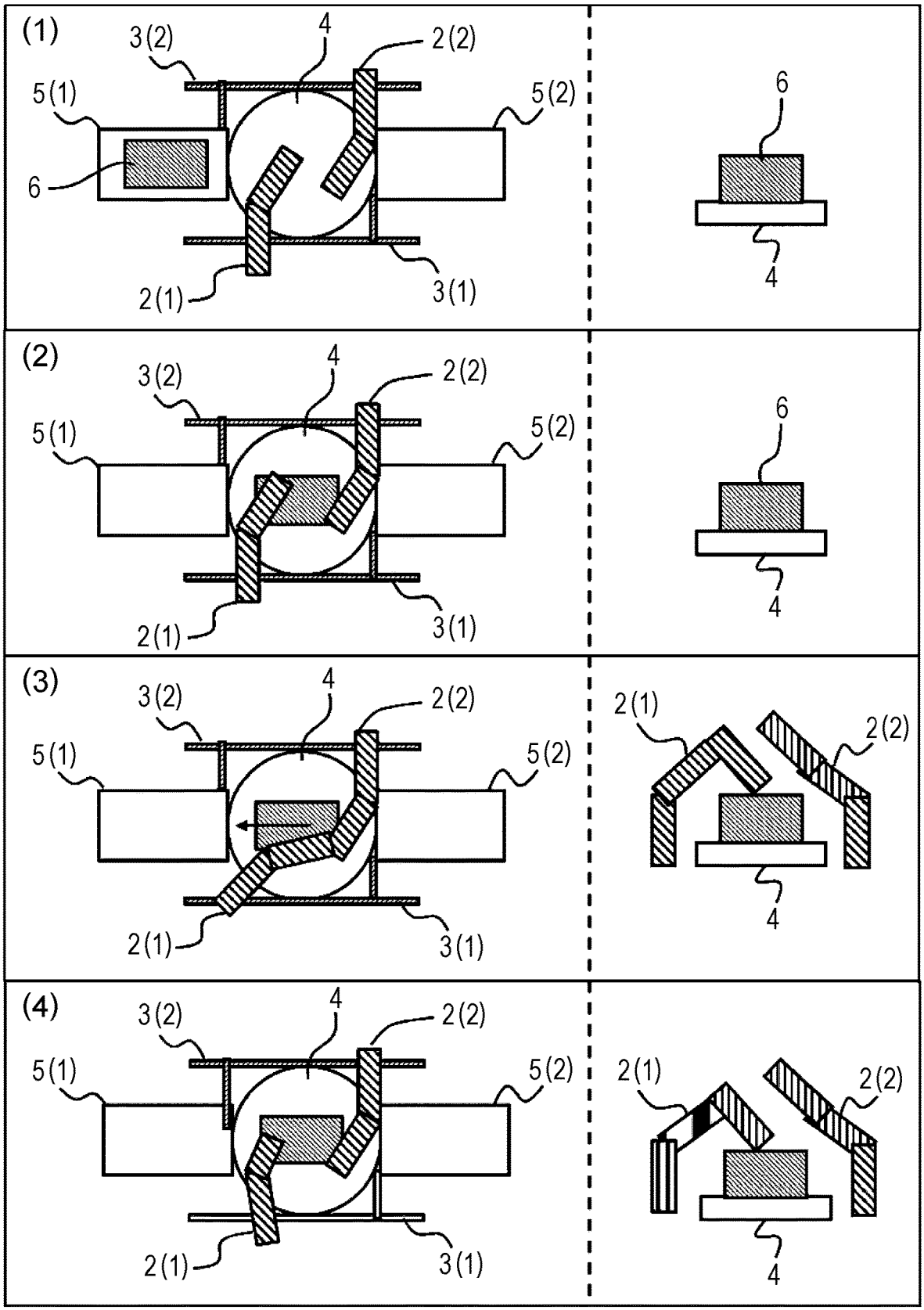
FIG. 15 is an explanatory view of steps (1) to (4) of a flow in a case of unpacking a corrugated cardboard box using two pairs of one unsealing/lid-opening robot and a flap cutting robot.
Figure 16:
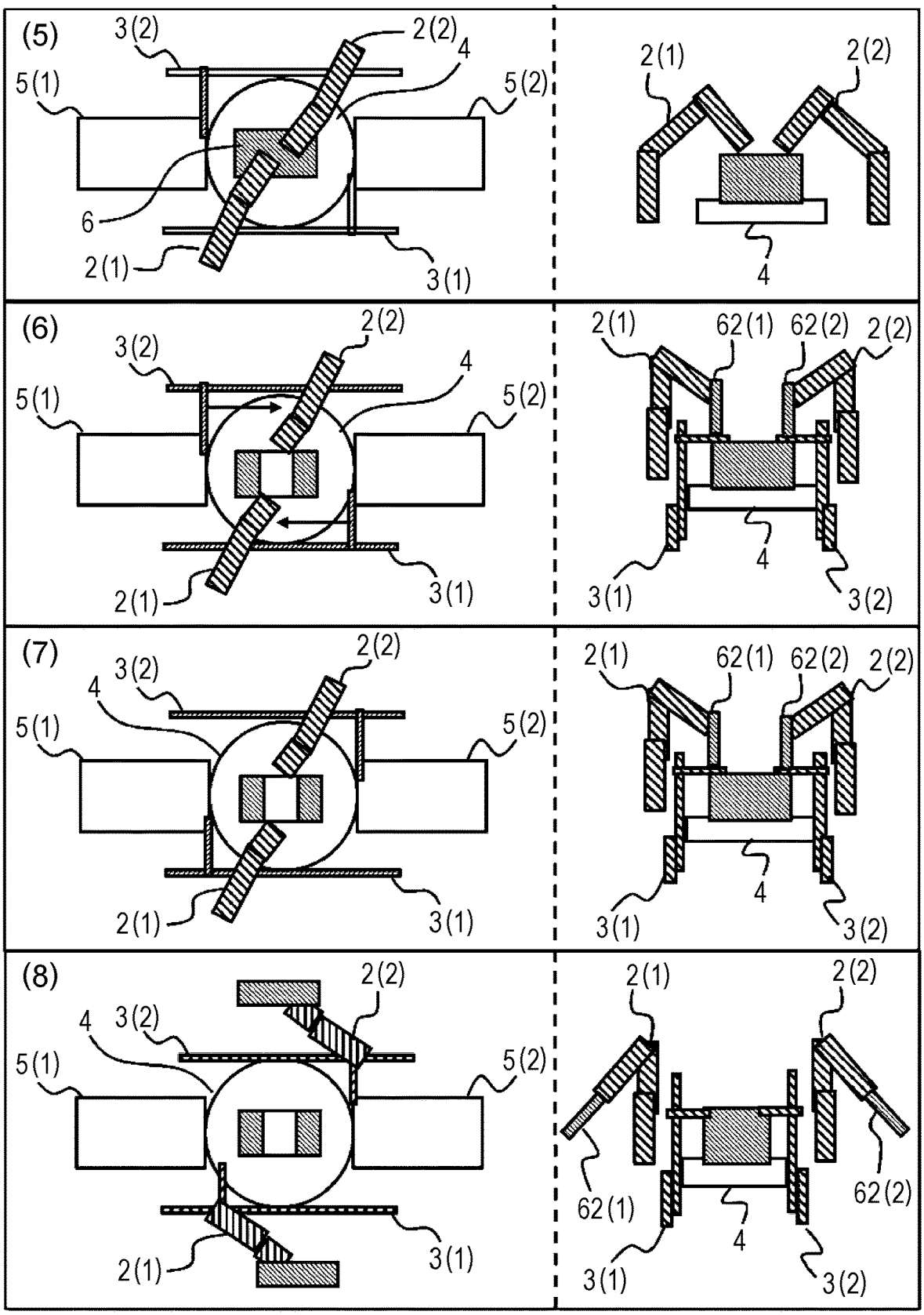
FIG. 16 is an explanatory view of steps (5) to (8) of the flow subsequent to the steps of FIG. 15.

Steps (1) to (4) of FIG. 15 and subsequent steps (5) to (8) of FIG. 16 illustrate the unpacking method in the case of a method using two unsealing robots 2 and two flap cutting robots 3 (referred to as a double cutter method for convenience). Since the basic flow of the double cutter method is the same as that of the single cutter method, only a part thereof will be described and the description of the other parts thereof will be omitted. In the double cutter method, a plurality of pairs of the unsealing robot 2 and the flap cutting robot 3 are arranged so as to face each other across the rotating table 4.

In the first step of FIG. 15(1), the unpacking controller 10 causes the conveyor 5(1) to carry the box 6 into the rotating table 4. In the second step illustrated in FIG. 15(2), the unpacking controller 10 recognizes a closed region (portion 63 of abutting) of the flap 62 by the camera 23 of one of the unsealing robots 2. In the third step of FIG. 15(3), the unpacking controller 10 starts unsealing the flap 62 by the unsealing robot 2. In the fourth step of FIG. 15(4), the unsealing of the flap by the unsealing robot 2 ends.

In the fifth step of FIG. 16(5), the unpacking controller 10 causes the suction hand 22 of each of the unsealing robots 2 to pull up each of the flaps and open the flap at a predetermined angle. In the sixth step of FIG. 16(6), the unpacking controller 10 causes each flap cutting robot 3 to start cutting the flap opened at the predetermined angle. In the seventh step of FIG. 16(7), the cutting of the flap ends. In the eighth step of FIG. 16(8), the unpacking controller 10 discards each of the flaps having been cut. The subsequent flow is similar to that described in steps (9) to (22) in FIGS. 11 through 14. The difference is that two pairs of the unsealing robot 2 and the flap cutting robot 3 operate concurrently. Accordingly, the processing speed of the double cutter method is twice as fast as that of the single cutter method.

According to the present example configured as described above, the flap 62 is cut by moving the cutter 31 of the flap cutting robot 3 along the side surface 611 of the box 6 in a state where the flap 62 is opened at a predetermined angle exceeding 90 degrees. In the present example, the fold line portion 621 between the base end side of the flap 62 opened at the predetermined angle and the side surface 611 of the box 6 becomes clear, and the flap 62 can be cut cleanly along the fold line portion 621. In the present example, since the flap 62 is cut at the fold line portion 621, the article 7 in the box 6 is not damaged by the cutter 31, thus improving the reliability of the unpacking system 1.

On the other hand, in a case where the flaps are cut at once by cutting around the upper side surface of the box 6, it is difficult to accurately align the position of the cutter (position in the height direction of the box for removing the flaps). Accordingly, there is a risk that the cutter damages the article in the box. In the present example, since the cutter 31 is moved along the side surface 611 of the box 6 in a state where the flap 62 is opened at a predetermined angle in advance, it is possible to cat only the flap 62 without damaging the article 7.

In the present example, the flap 62 can be removed cleanly from the base end side, thus also improving the work efficiency of the picking process in which the article in the box 6 is recognized by image processing and taken out.

Furthermore, in the present example, since the height dimension H1 of the blade 211 of the multi-cutter 21 is set shorter than the thickness dimension H2 of the flap 62, there is no risk that the blade 211 damages the article 7 in the box 6. Accordingly, the reliability of the unpacking system 1 can be further increased by combining the flap unsealing method and the flap cutting method.

Figure 17:
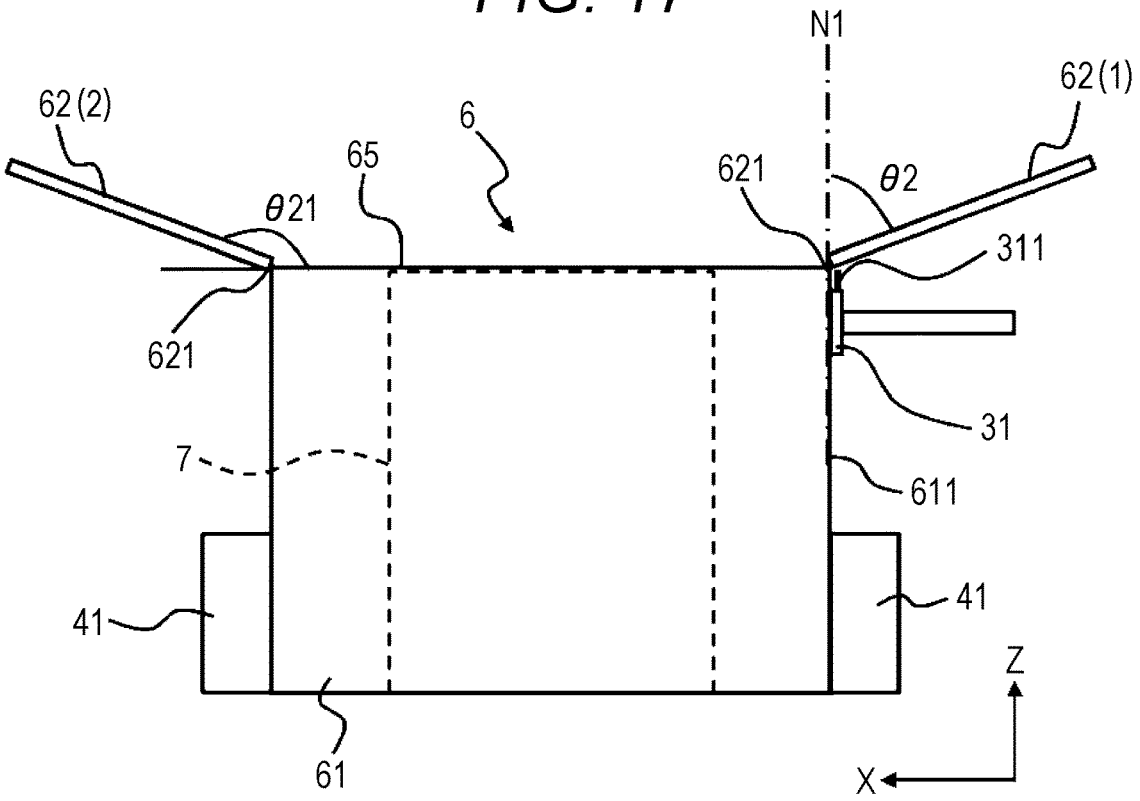
FIG. 17 is a first modification in which the angle of a cutting target flap is changed.

FIG. 17 illustrates a first modification in which a predetermined angle of the cutting target flap is changed. In the first example, the case where the predetermined angle θ1 is set to approximately 180 degrees has been described. On the other hand, in the first modification, a predetermined angle θ2 is set to a value exceeding 90 degrees and smaller than 180 degrees (90 degrees <θ2<180 degrees). In the first modification, the flap 62 may form an acute angle with respect to the normal N1 of the outlet 65. With reference to a plane parallel to the outlet 65, the flap 62 is opened so as to form an angle θ21 with respect to the plane parallel to the outlet 65.

Figure 18:
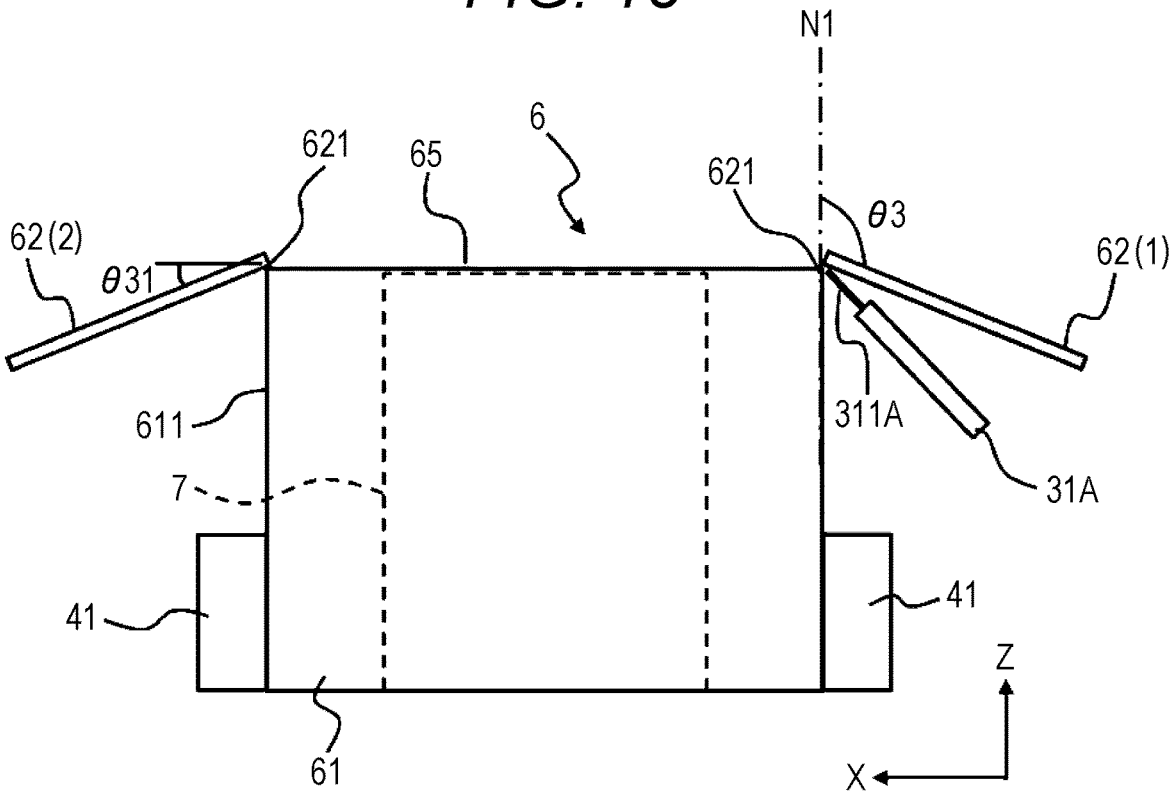
FIG. 18 is a second modification in which the angle of a cutting target flap is changed.

FIG. 18 illustrates a second modification in which a predetermined angle of the cutting target flap is changed. In the second modification, a predetermined angle θ3 is set to a value exceeding 90 degrees and to be an obtuse angle with respect to the normal N1 of the outlet 65. The flap 62 is made into a so-called overhang state for the cutter 31, and is cut along the side surface 611 from obliquely below the flap 62. With reference to a plane parallel to the outlet 65, the flap 62 is opened so as to form an angle θ31 with respect to the plane parallel to the outlet 65.

Second Example

Figure 19:
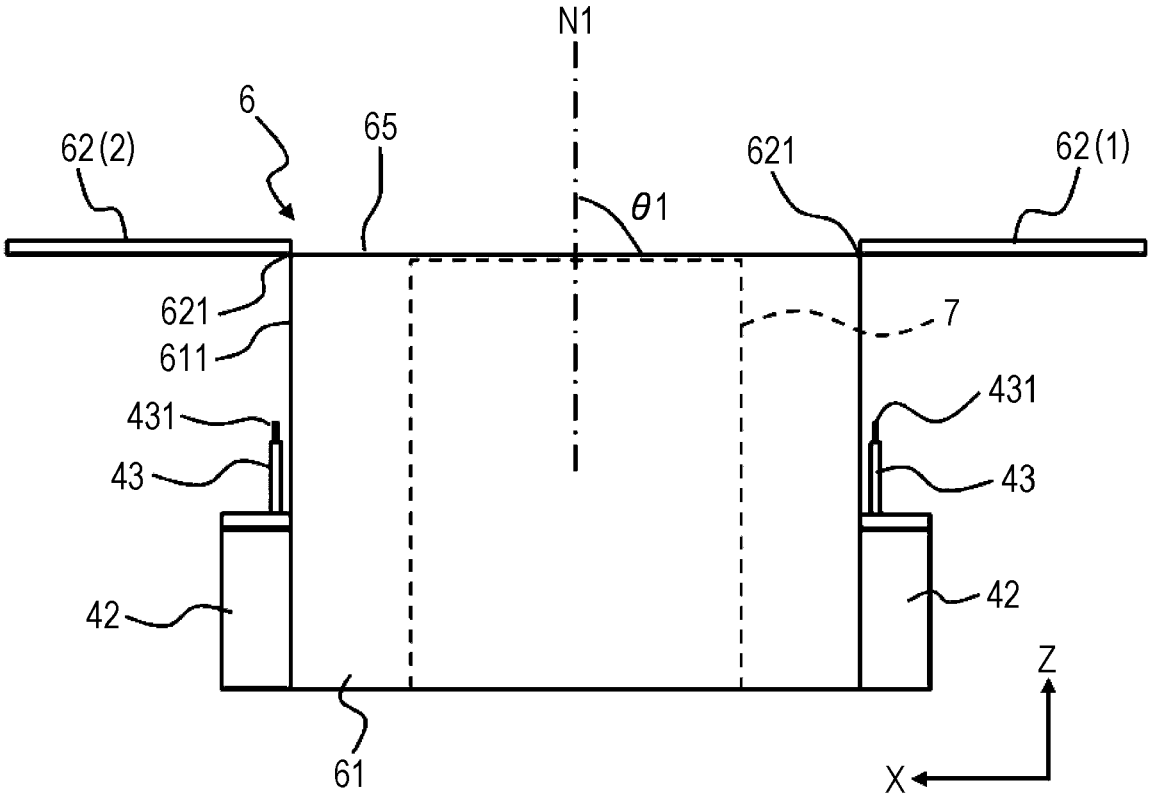
FIG. 19 is an explanatory view of an unpacking system according to a second example in which a pusher and a flap cutting cutter are integrated.

A second example will be described with reference to FIG. 19. In the present example, differences from the first example will be mainly described. In the present example, the pusher 42 is provided with a flap cutting function.

A flap cutting mechanism 43 is provided above the pusher 42 of the present example. A flap cutting cutter 431 is provided at the tip of the flap cutting mechanism 43. The flap cutting mechanism 43 is configured as, for example, a 3-axis movable robot. From the state of FIG. 19, the flap cutting mechanism 43 extends in the Z-axis direction, and the cutter 431 comes into contact with the fold line portion 621. Then, the cutter 431 cuts the flap 62 while moving in the depth direction (Y-axis direction) perpendicular to the paper surface by the flap cutting mechanism 43.

The present example configured as described above also achieves the same operations and effects as those of the first example. Furthermore, in the present example, the pusher 42 and the flap cutting mechanism 43 are integrated, thus allowing the overall size to be made compact.

The present invention is not limited to the above embodiment, and includes various modifications. The above embodiment has been described in detail in order to explain the present invention in an easy-to-understand manner, and is not necessarily limited to those including all the configurations described. It is also possible to replace part of the configuration of one embodiment with the configuration of another embodiment. In addition, the configuration of another embodiment can be added to the configuration of one embodiment. Other configurations can be added to, deleted from, or replaced with part of the configuration of each embodiment.

Each component of the present invention can be selected in any manner, and an invention having a selected configuration is also included in the present invention. In addition, the configurations described in the claims can be combined other than the combinations specified in the claims.

What is claimed is:

1. An unpacking system that unpacks a box having flaps, comprising:

a first conveyor;

a rotatable table downstream from the first conveyor;

a second conveyor downstream from the rotatable table;

an unsealing unit including a first cutter that cuts a region where flaps of the box facing each other in a closed state abut each other while the box is on the rotatable table;

a lid-opening unit including a suction hand that opens, at a predetermined angle exceeding 90 degrees, a predetermined flap of the flaps having been cut by the unsealing unit while the box is on the rotatable table;

a flap cutting unit including a second cutter that cuts, along a side surface of the box and from underneath the predetermined flap, a base end side of the predetermined flap opened at the predetermined angle while the box is on the rotatable table and while the flap cutting unit is continuously pressed against the side surface of the box; and a controller connected to each of the first conveyor, the second conveyor and the rotatable table, wherein the controller is configured to convey the box from the first conveyor to the rotatable table and convey the box from the rotatable table to the second conveyor, and wherein the unsealing unit cuts the region by using the first cutter which has a dimension less than an entire thickness dimension of the flaps and the depth of the cut by the first cutter in the region is less than the entire thickness of the flaps.

2. The unpacking system according to claim 1, further comprising a support unit that supports a predetermined side surface of side surfaces of the box, the side surface contiguous with respect to the base end side of the predetermined flap.

3. The unpacking system according to claim 1, wherein the predetermined angle is an acute angle with respect to a side surface of the box.

4. The unpacking system according to claim 1, wherein the unpacking system is arranged in a preceding stage of a process in which image recognition of an article in the box is performed by a camera.

5. An unpacking method for unpacking a box having flaps, comprising:

conveying the box to a rotatable table;

conveying the box from the rotatable table to a second conveyor which is downstream from the rotatable table;

an unsealing step including cutting, by a first cutter, region where flaps of the box facing each other in a closed state abut each other while the box is on the rotatable table;

a lid-opening step in which a predetermined flap of the flaps having been cut by the unsealing step is opened by a suction hand to a predetermined angle exceeding 90 degrees by a lid-opening mechanism while the box is on the rotatable table; and a flap cutting step including cutting a base end side of the predetermined flap opened at the predetermined angle along a side surface of the box and from underneath the predetermined flap by a flap cutting mechanism while the box is on the rotatable table and while the flap cutting unit is continuously pressed against the side surface of the box, wherein the unsealing unit cuts the region by using the first cutter which has a dimension less than an entire thickness dimension of the flaps and the depth of the cut by the first cutter in the region is less than the entire thickness of the flaps.

* * * * *